US008676585B1

(12) United States Patent
Nguyen et al.

(10) Patent No.: US 8,676,585 B1
(45) Date of Patent: Mar. 18, 2014

(54) SYNCHRONIZING THE PLAYING AND DISPLAYING OF DIGITAL CONTENT

(71) Applicant: Amazon Technologies, Inc., Reno, NV (US)

(72) Inventors: Laurent Ah Minh Nguyen, Los Altos, CA (US); Sailesh Rachabathuni, Santa Clara, CA (US); Dennis Paul Fleming, Belmont, CA (US); Robert Wai-Chi Chu, Santa Clara, CA (US); Edward J. Gayles, Tracy, CA (US); David Berbessou, Sunnyvale, CA (US)

(73) Assignee: Amazon Technologies, Inc., Reno, NV (US)

( * ) Notice: Subject to any disclaimer, the term of this patent is extended or adjusted under 35 U.S.C. 154(b) by 0 days.

(21) Appl. No.: 13/653,204

(22) Filed: Oct. 16, 2012

Related U.S. Application Data

(63) Continuation of application No. 12/483,479, filed on Jun. 12, 2009, now Pat. No. 8,290,777.

(51) Int. Cl.
*G10L 13/08* (2013.01)

(52) U.S. Cl.
USPC ..... 704/260

(58) Field of Classification Search
USPC ..... 704/260
See application file for complete search history.

(56) References Cited

U.S. PATENT DOCUMENTS

| | | | | |
|---|---|---|---|---|
| 5,893,132 | A * | 4/1999 | Huffman et al. | 715/201 |
| 5,986,690 | A | 11/1999 | Hendricks | |
| 6,243,075 | B1 | 6/2001 | Fishkin et al. | |
| 6,486,895 | B1 * | 11/2002 | Robertson et al. | 715/776 |
| 6,745,163 | B1 * | 6/2004 | Brocious et al. | 704/260 |
| 7,685,514 | B1 * | 3/2010 | Khatwani et al. | 715/251 |
| 2002/0087555 | A1 * | 7/2002 | Murata | 707/10 |
| 2004/0139400 | A1 * | 7/2004 | Allam et al. | 715/526 |
| 2004/0215689 | A1 * | 10/2004 | Dooley et al. | 709/200 |
| 2005/0210048 | A1 * | 9/2005 | Beres et al. | 707/100 |
| 2005/0246631 | A1 * | 11/2005 | Mori et al. | 715/515 |
| 2006/0029296 | A1 | 2/2006 | King et al. | |
| 2006/0098899 | A1 | 5/2006 | King et al. | |
| 2006/0143559 | A1 | 6/2006 | Spielberg et al. | |
| 2008/0065974 | A1 | 3/2008 | Campbell | |
| 2008/0066080 | A1 | 3/2008 | Campbell | |
| 2008/0114599 | A1 * | 5/2008 | Slotznick et al. | 704/260 |
| 2008/0119953 | A1 | 5/2008 | Reed et al. | |
| 2008/0120330 | A1 | 5/2008 | Reed et al. | |
| 2008/0120342 | A1 | 5/2008 | Reed et al. | |
| 2009/0241054 | A1 | 9/2009 | Hendricks | |
| 2009/0326953 | A1 * | 12/2009 | Peralta Gimenez et al. | 704/270.1 |
| 2010/0050064 | A1 * | 2/2010 | Liu et al. | 715/202 |
| 2012/0046947 | A1 * | 2/2012 | Fleizach | 704/260 |

OTHER PUBLICATIONS

U.S. Appl. No. 12/483,479, filed Jun. 12, 2009, Laurent An Minh Nguyen et al., "Synchronizing the Playing and Displaying of Digital Content".

* cited by examiner

*Primary Examiner* — Jakieda Jackson
(74) *Attorney, Agent, or Firm* — Lee & Hayes, PLLC

(57) ABSTRACT

The techniques disclosed herein allow a user to synchronize the playing and displaying of digital content on an electronic device. The device may render a first portion of digital content so it may be displayed. The device may also play a segment of the digital content as audio using text to speech software. The device may also render a second portion of digital content for display depending on whether the position of the last word read is greater than the last position in the first portion of digital content.

20 Claims, 8 Drawing Sheets

SYNCHRONIZING THE PLAYING AND DISPLAYING OF DIGITAL CONTENT

PRIORITY

The present application is a continuation of, and claims priority to, pending U.S. application Ser. No. 12/483,479, filed on Jun. 12, 2009, entitled "Synchronizing the Playing and Displaying of Digital Content," which is incorporated by reference herein in its entirety.

BACKGROUND

Electronic distribution of information has gained in importance with the proliferation of personal computers and has undergone a tremendous upsurge in popularity as the Internet has become widely available. With the widespread use of the Internet, it has become possible to distribute large, coherent units of information using electronic technologies.

Advances in electronic and computer-related technologies have permitted computers to be packaged into smaller and more powerful electronic devices. An electronic device may be used to receive and process information. The electronic device may provide compact storage of the information as well as ease of access to the information. For example, a single electronic device may store a large quantity of information that might be downloaded instantaneously at any time via the Internet. In addition, the electronic device may be backed up, so that physical damage to the device does not necessarily correspond to a loss of the information stored on the device.

In addition, a user may interact with the electronic device. For example, the user may read information that is displayed or hear audio that is produced by the electronic device. Further, the user may instruct the device to display or play a specific piece of information stored on the electronic device. As such, benefits may be realized from improved systems and methods for interacting with an electronic device.

DETAILED DESCRIPTION

The present disclosure relates generally to digital media. Currently, digital text is available in a variety of forms. For example, publishers of printed materials frequently make digital media equivalents, known as e-books, available to their customers. E-books may be read on dedicated hardware devices known as e-book readers (or e-book devices), or on other types of computing devices, such as personal computers, laptop computers, personal digital assistants (PDAs), etc.

Under some circumstances, a person may want to listen to an e-book rather than read the e-book. For example, a person may be in a dark environment, may be fatigued from a large amount of reading, or may be involved in activity that makes reading more difficult or not possible. Additionally, publishers and authors may want to give their customers another, more dynamic, avenue to experience their works by listening to them. Despite these advantages, it may be expensive and impractical to record the reading of printed material. For example, a publisher might incur expenses associated with hiring professionals to read aloud and record their material. Additionally, some printed materials, such as newspapers or other periodicals, may change weekly or even daily, thus requiring a significant commitment of resources.

The present disclosure relates to automatically synthesizing digital text into audio that can be played aloud. This synthesizing may be performed by "text to speech" (TTS) software operating on an electronic device. By automatically synthesizing text into audio, much of the cost and inconvenience of providing audio may be alleviated.

The techniques disclosed herein allow users to have displayed text read aloud and have the displayed content updated automatically at the correct time. TTS software receives a block of text and forms the audio for each word in the text. However, the received text may not have page delineations. As such, it may be difficult to determine when to update the display while reading text aloud. Therefore, an electronic device may add markings in the text to track the position, within the displayed content, of the words being read aloud.

Additionally, the displayed content may be updated depending on user options. For example, a display in landscape mode may include a different number of words than in portrait mode. Likewise, using a large font size may decrease the number of displayed words on a screen compared to a small font size. Therefore, after text and/or images are displayed, an electronic device may find the last word in the displayed content. The TTS software may then compare the markings to the last word in the displayed content. If the word being read aloud is before the last word in the displayed content, the electronic device is displaying the correct content. If, however, the word being read aloud is after the last word in the displayed content, the electronic device may update the display to display the text being read aloud.

Figure 1:
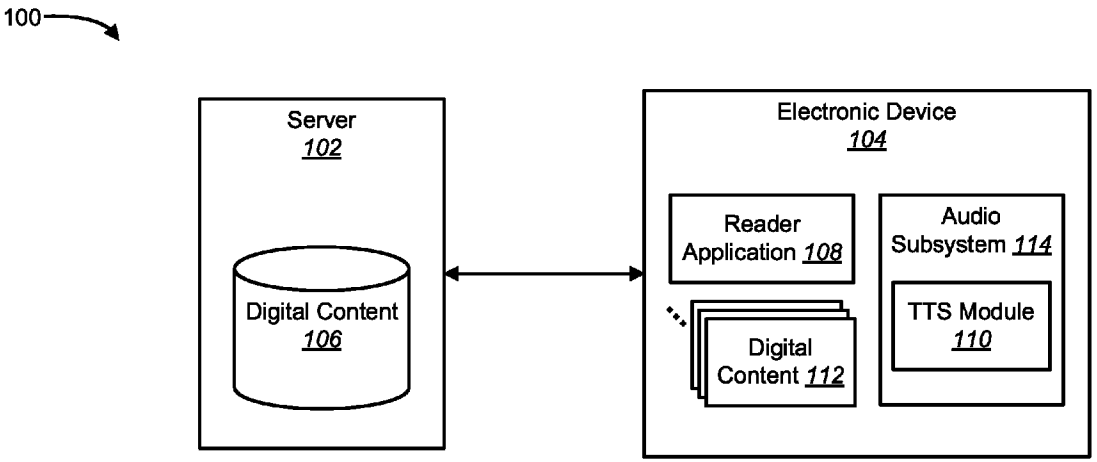
FIG. 1 is a block diagram illustrating a system for using a text to speech module.

FIG. 1 is a block diagram illustrating a system 100 for using a TTS module 110. In this system 100, a server 102 may communicate with an electronic device 104. The server 102 may be any type of computing device capable of communicating with other electronic devices 104 and storing digital content 106. Likewise, an electronic device 104 may be any computing device capable of visually displaying and audibly playing data. Some examples of electronic devices 104 include, but are not limited to, a personal computer, a laptop computer, a personal digital assistant, a mobile communications device, a smartphone, an electronic book (e-book) reader, a tablet computer, a set-top box, a game console, etc.

The digital content 106 may reside on the server 102. Additionally, digital content 112 may be installed on or downloaded to the electronic device 104. Digital content 106, 112 may include various kinds of electronic books (eBooks), electronic magazines, music files (e.g., MP3s), video files, etc. Electronic books ("eBooks") are digital works. The terms "eBook" and "digital work" are used synonymously and, as used herein, may include any type of content which may be stored and distributed in digital form. By way of illustration, without limitation, digital works and eBooks may include all forms of textual information such as books, magazines, newspapers, newsletters, periodicals, journals, reference materials, telephone books, textbooks, anthologies, proceedings of meetings, forms, directories, maps, manuals, guides, references, photographs, articles, reports, documents, etc., and all forms of audio and audiovisual works such as music, multimedia presentations, audio books, movies, etc.

The electronic device 104 may include a reader application 108 and an audio subsystem 114. The reader application 108 may include a user interface for receiving input from a user. The reader application 108 may also render digital content 112 for display and send the digital content 112 to the audio subsystem 114 for use in the TTS module 110. Further, the reader application 108 may manage access to digital content 112 with digital rights management (DRM) protection.

The audio subsystem 114 may reside on the electronic device 104 and may include the TTS module 110. The TTS module 110 may convert text data in the digital content 112 into digital audio information. Thus, using the output of the TTS module 110, an audio player may play audio relating to text. In this way, the electronic device may "read" text as audio (audible speech). As used herein, the term "read" or "reading" means to audibly reproduce text to simulate a human reading the text out loud. Additionally, the electronic device 104 may include a display that may visually display text relating to the digital content 112. Furthermore, the electronic device 104 may utilize both a display and the audio subsystem 114 at the same time. For instance, a display might show the text of an eBook on a screen for a user to view while the audio subsystem 114 may read the digital content 112 aloud. The functionality of the TTS module 110 will be discussed in further detail below.

Figure 2:
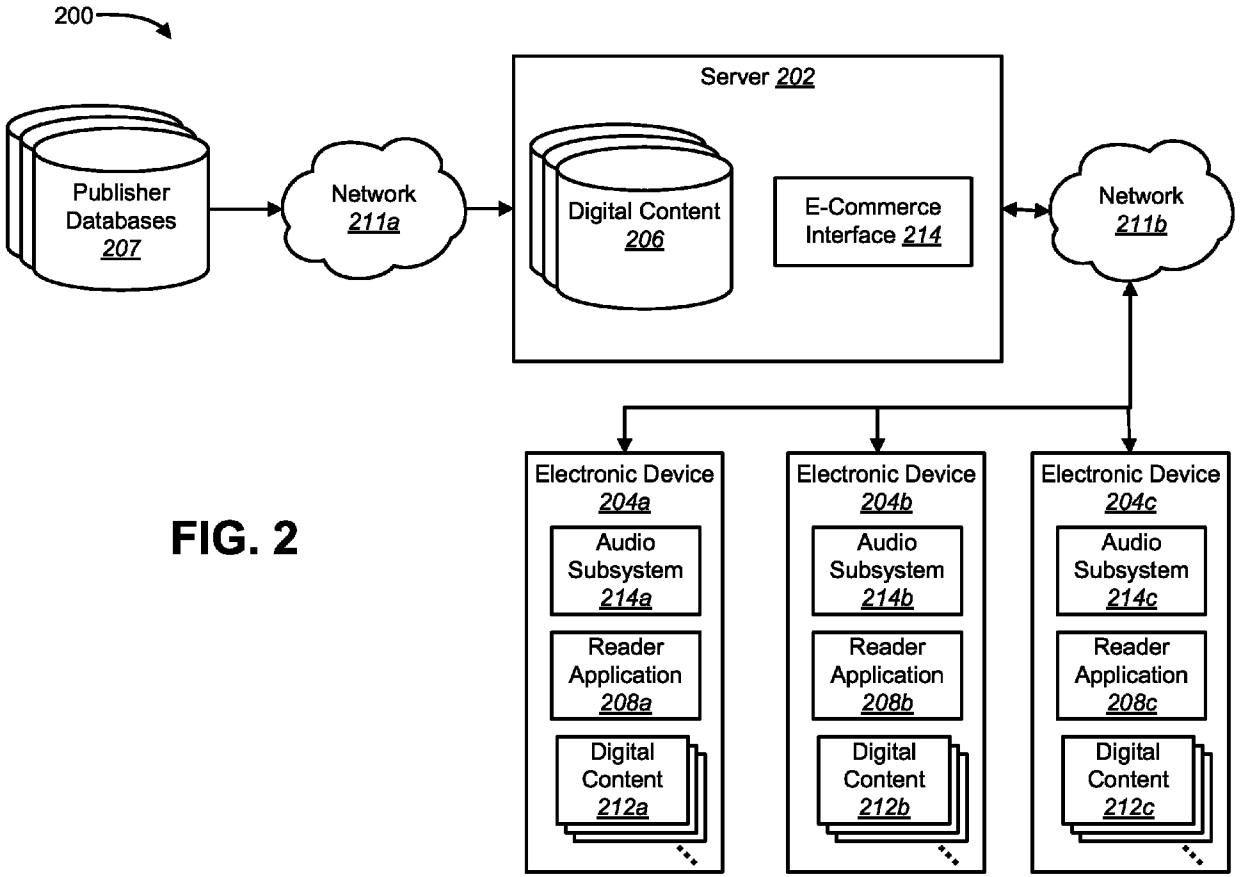
FIG. 2 is a block diagram illustrating a system for distributing digital content for use by one or more electronic devices.

FIG. 2 is a block diagram illustrating a system 200 for distributing digital content 206 for use by one or more electronic devices 204. In this system 200, multiple publisher databases 207 may communicate with a server 202 through a network 211*a*. In this configuration, the publisher databases 207 may send the digital content 206 to the server 202. The publisher databases 207 represent the publishers and/or creators of digital content 206 and may transmit their content to the server 202 only once or periodically. For example, a book publisher may send a particular eBook to the server 202 only once because the content of the book may not change, but a newspaper publisher may send its content every day, or multiple times a day, as the content changes frequently.

In addition to the digital content 206, the server 202 may include a network based electronic commerce (e-commerce) interface 214. The ecommerce interface 214 may allow one or more electronic devices 204 to communicate with the server 202 over a network 211*b*, such as the Internet, and to further interact with the digital content 206. The electronic devices 204 may view, sample, purchase, or downloading the digital content 212. For example, the first electronic device 204*a* may download and store a copy of the digital content 212*a*, the second electronic device 204*b* may download and store a copy of the digital content 212*b*, and the third electronic device 204*c* may download and store a copy of the digital content 212*c*. E-commerce interfaces 214 may be implemented in any suitable manner, such as providing web pages viewable with an Internet browser on the electronic device 204.

Additionally, the electronic devices 204 may also include a reader application 208*a*, 208*b*, 208*c* and audio subsystem 214*a*, 214*b*, 214*c*. The audio subsystem 208 may include a TTS module 110 that reads the digital content 212 aloud. The reader application 208 may update the display as the digital content 212 is read by the TTS module 110.

Figure 3:
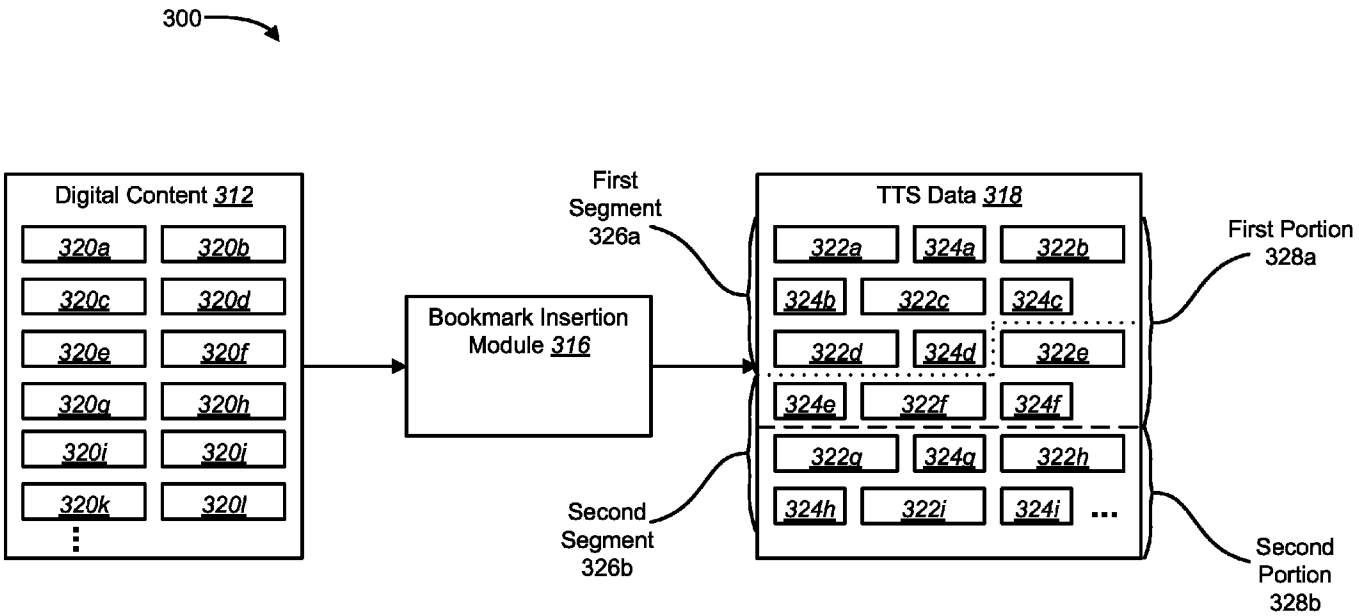
FIG. 3 is a block diagram illustrating a system for marking digital content.

FIG. 3 is a block diagram illustrating a system 300 for marking digital content 312. The system 300 may be implemented in an electronic device 204. The system 300 may insert bookmarks 324 into the digital content 312. The digital content 312 may include text and images that may be divided internally by the electronic device 204 into text units 320. A text unit 320 may be any amount of data, e.g., two words, three words, one sentence, one image, etc. The digital content 312 illustrated in FIG. 3 is shown with text units 320*a*-320*l*. Alternatively, or in addition to, the digital content 312 may be organized using tabulated content, e.g., tables. One of the problems with digital content 312 may be a lack of page delineations, i.e., depending on the display properties, a displayed portion of digital content may end after any of the text units 320. For example, with a large font size, a displayed portion of digital content may end after an early text unit 320*g*. In contrast, a displayed portion of digital content with a small font size may end after a later text unit 320*k*. Therefore, if the electronic device 204 reads the digital content 312 aloud, it may be difficult to determine when to update the display.

A bookmark insertion module 316 may insert bookmarks 324 into the digital content 312 to help track the position of the text being read. Each word in the digital content 312 may be associated with a position, e.g., the first word in the digital content 312 may have a position of "1", the twentieth word in the digital content 312 may have a position of "20", etc. A bookmark 324 may be any data that is recognizable by a TTS module 110 and indicates the position of text or images, e.g., a string inserted every two or three words in the digital content 312. The TTS data 318 may include the data from the digital content 312 and bookmarks 324. The TTS data 318 illustrated in FIG. 3 is shown with bookmarks 324*a*-324*i* corresponding to text units 322*a*-322*i*, e.g., a particular bookmark 324*b* indicates the position of a corresponding text unit 322*b*. In other words, a bookmark 324 may be inserted for each text unit 322. For example if each text unit 322 illustrated is two words, the first bookmark 324*a* may indicate a position of "2" and the second bookmark 324*b* may indicate a position of "4". Alternatively, if the digital content 312 is organized using tables, the bookmark insertion module 316 may insert bookmarks 324 in the tables to indicate the position of text or images.

After bookmark 324 insertion, the TTS data 318 may then be sent in segments 326 to an audio subsystem 114 for reading. A segment 326 may include several text units 322 and bookmarks 324. For example, the first segment 326*a* may be sent to the audio subsystem 114 first for reading. When the audio subsystem 114 needs more data, the second segment 326*b* may be sent. A segment 326 may have no predefined relation to the portions 328 of digital content 312 that are ultimately rendered and displayed on the electronic device 204. In other words, multiple segments 326 may be included in a portion 328 or multiple portions may be included in a segment 326. A portion 328 of digital content 312 may include the text and/or images that are displayed on the electronic device 204 at one time. For illustration purposes, a first portion 328*a* delineation is shown in the TTS data 318. The TTS data 318 may not include such portion delineations since the portions 328 may be rendered for display directly from the digital content 312, however, delineations are shown for the purpose of illustration. The data that may ultimately be rendered into a first portion 328*a* is shown including the first segment 326*a* and part of the second segment 326*b*. Furthermore, the second portion 328*b* may ultimately include part of the second segment 326*b* and at least part of a third segment.

In one configuration, the bookmarks 324 are not inserted into the digital content 312 itself, but rather into the segments 326 as they are being sent to an audio subsystem 114. In other words, the bookmarks 324 may be inserted into a temporary copy of a segment 326 that is to be sent to the audio subsystem 114 and played. In this configuration, the digital content 312 may remain unchanged and bookmarks 324 are inserted into a temporary copy of a segment 326.

As segments 326 are sent to the audio subsystem 114, a TTS module 110 may process the text units 322 for reading and then compare the most recently processed bookmark 324, which may be referred to herein as the current bookmark, to the last position on the currently rendered portion 328. For example, the TTS module 110 may compile the first text unit 322*a* into audio and then compare the first bookmark 324*a* to the last position on the first portion 328*a*. In the depicted example, the position of the first bookmark 324*a* is less than the last position on the first portion 328*a*, so the TTS module 110 may continue processing the text units 322 until it processes the seventh text unit 322*g* and the seventh bookmark 324*g*. At this point, the seventh bookmark 324*g* is larger than the last position in the first portion 328*a*. Thus, the audio subsystem 114 may notify a reader application 108 to display a second portion 328*b*.

Figure 4:
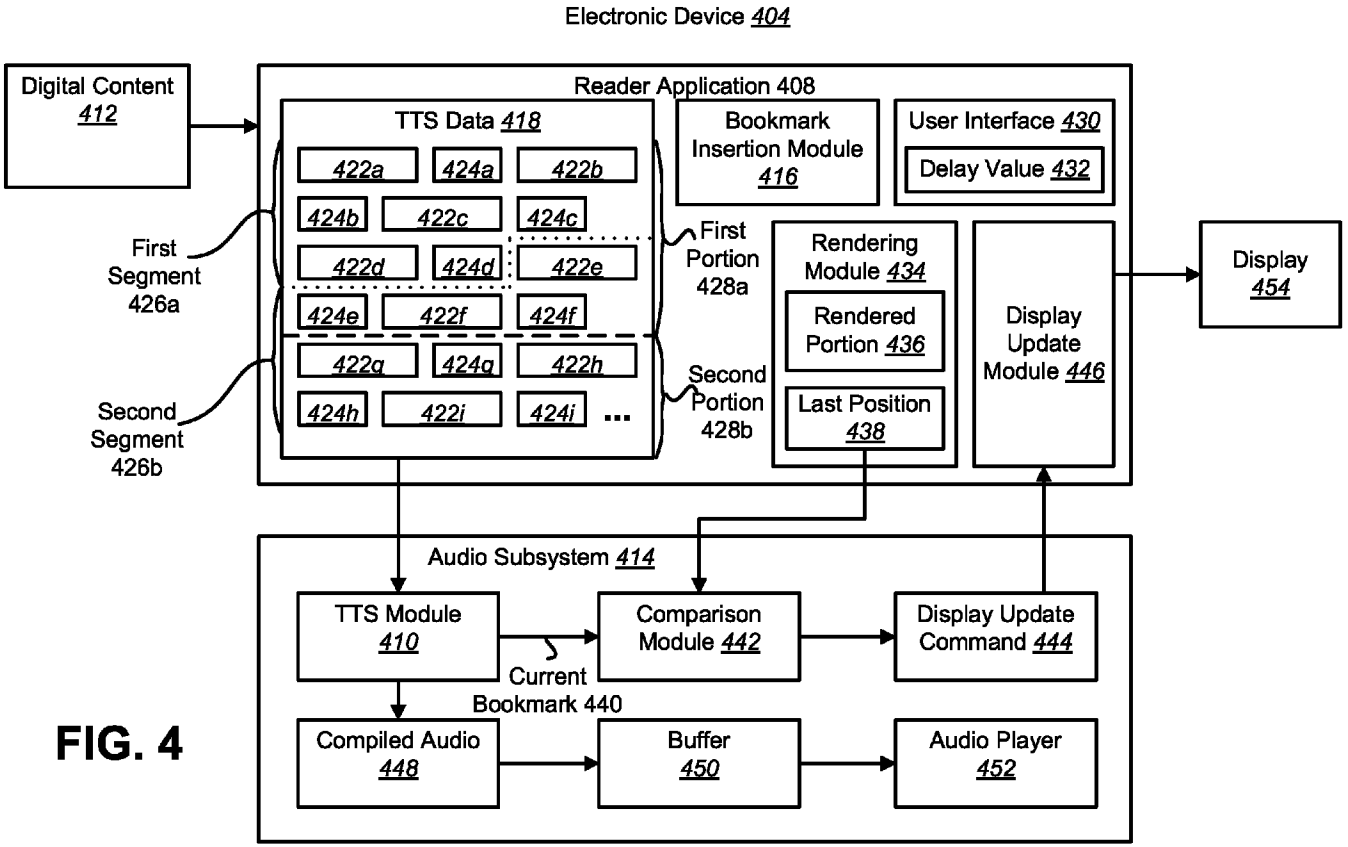
FIG. 4 is a block diagram illustrating an electronic device for synchronizing the playing and displaying of digital content.

FIG. 4 is a block diagram illustrating an electronic device 404 for synchronizing the playing and displaying of digital content 412. For example, the electronic device 404 may read aloud the digital content 412 while displaying the portion currently being read. The electronic device 404 may include a reader application 408, an audio subsystem 414, and a display 454. The display 454 may be an electronic paper display. Electronic paper displays may reflect light in a similar manner to ordinary paper and may be capable of holding text and images indefinitely without drawing electricity, while allowing the text and images to be changed later. One example of an electronic paper display that may be used is an E-Ink® display, manufactured by Prime View International Co., Ltd. There are several different technologies that may be used to create electronic paper displays. For example, electronic paper displays may be electrophoretic displays, bistable liquid crystal displays (LCD), cholesteric LCD displays, etc.

The reader application 408 may include a bookmark insertion module 416, a user interface 430, a rendering module 434, and a display update module 446. The bookmark insertion module 416 may insert bookmarks into the digital content 412 to produce TTS data 418 as described in FIG. 3. The user interface 430 may allow a user to interact with the electronic device 404, e.g., open an e-book, start TTS, stop TTS, etc. Additionally, the user interface 430 may manage user preferences. One such preference may be a delay for portions 428 that include only images or mostly images. This delay may be indicated by a delay value 432, e.g., two seconds, five seconds, ten seconds. The rendering module 434 may render portions 436 to be displayed on the display 454. Before rendering, the last position 438 on the displayed portion maybe unknown. As the rendering module 434 renders a portion 436, it may detect the last position 438 of the rendered portion 436 and send the last position 438 to the audio subsystem 414. The last position 438 may be the position of the last word or image that is displayed on the display 454. The last position 438 may be compared by the audio subsystem 414 to the word currently being read aloud or being compiled for reading. Based on this comparison, a display update command 444 may be issued. The display update module 446 may be responsible for updating the display 454 with the rendered portion 436.

The TTS data 418 may be the data sent to the audio subsystem 414 for reading and may be organized into segments 426. Data from multiple segments 426 may be displayed in each portion 428. In other words, the data that is ultimately rendered into the first portion 428*a* may include data from the first segment 426*a* and part of the second segment 426*b*, while the data that is ultimately rendered into the second portion 428*b* may include data from the second segment 426*b* and at least part of a third segment. Alternatively, a segment 426 may include more than a portion 428 of data. The TTS data 418 may include bookmarks 424*a*-424*i* inserted after each text unit 422*a*-422*i*, e.g., a bookmark 424 inserted after every two words, three words, every image, etc. Alternatively, image data may not be included in the segments 426 that are sent to the audio subsystem 414. Although the TTS data 418 is illustrated with portion delineations, the TTS data 418 may not include such delineations because the last position 438 of a rendered portion 436 may not be determined when the TTS data 418 is created. In other words, since the last position 438 may be determined after rendering, and the TTS data 418 may not be created from any rendered data, the TTS data 418 may not have portion delineations. The TTS data 418 may be sent to the audio subsystem 414 in segments 426.

The audio subsystem 414 may include a TTS module 410, a comparison module 442, a buffer 450, and an audio player 452. The TTS module 410 may receive the segments 426 from the reader application 408 and process the text units 422 into audio frames, i.e., compiled audio 448. The compiled audio 448 may then be passed to the buffer 450 that may be used to reduce distortion and/or amplify the compiled audio 448 before it is fed into the audio player 452. Additionally, the audio subsystem 414 may request more segments 426 from the reader application 408 when it is has almost processed all the received segments 426. Furthermore, the audio subsystem 414 may stop or resume reading, e.g. at the direction of the user interface 430.

The TTS module 410 may process the text units 422 in the received segments 426. As the TTS module 410 encounters each bookmark 424, it may pass the most recently processed bookmark 440, which may be referred to herein as the current bookmark 440, to the comparison module 442. This may allow the comparison module 442 to compare the words being spoken or about to be spoken, indicated by the current bookmark 440, to the last position 438 received from the rendering module 434. In this way, the audio subsystem 414 may accurately determine when words are actually being spoken, which was previously not possible since the segments 426 may not include portion delineations. Thus, in one configuration, the position of the word most recently compiled, the current bookmark 440, is compared to the last position 438.

Alternatively, since the buffer 450 may introduce a small delay (e.g., two seconds) between compiling and playing the audio 448, the audio 448 may be tagged with a position. Then, once the audio 448 is actually played in the audio player 452 (rather than compiled), the comparison module 442 may compare the position of the word actually read aloud to the last position 438. Thus, depending on the configuration, the position of the word most recently compiled or played may be compared to the last position 438 in the displayed portion.

If the current bookmark 440 is less than or equal to the last position 438, this may indicate that the electronic device 404 is displaying the TTS data 418 that is currently being read, i.e., the correct portion of digital content 412. If the current bookmark 440 is greater than the last position 438, this may indicate that the electronic device 404 is not displaying the TTS data 418 that is currently being read, i.e., displaying a previous portion. In this case, the comparison module 442 may generate a display update command 444 that may be sent to the display update module 446. The display update module 446 may then update the display 454 to the next portion in the digital content 412 and the rendering module 434 may send the last position 438 of the newly displayed portion 436.

In this way, the electronic device 404 may synchronize the display updates within n words, where n may represent the size of a text unit 422. The lower n is, the more accurate the synchronization may be, e.g., n=1 means that bookmarks 424 are inserted after every word or image and, consequently, the comparison module compares the current bookmark 440 to the last position 438 after processing every word. However, a low value of n that causes many bookmarks 424 to be inserted into the digital content 412 may also require more processing resources in the electronic device 404.

Figure 5:
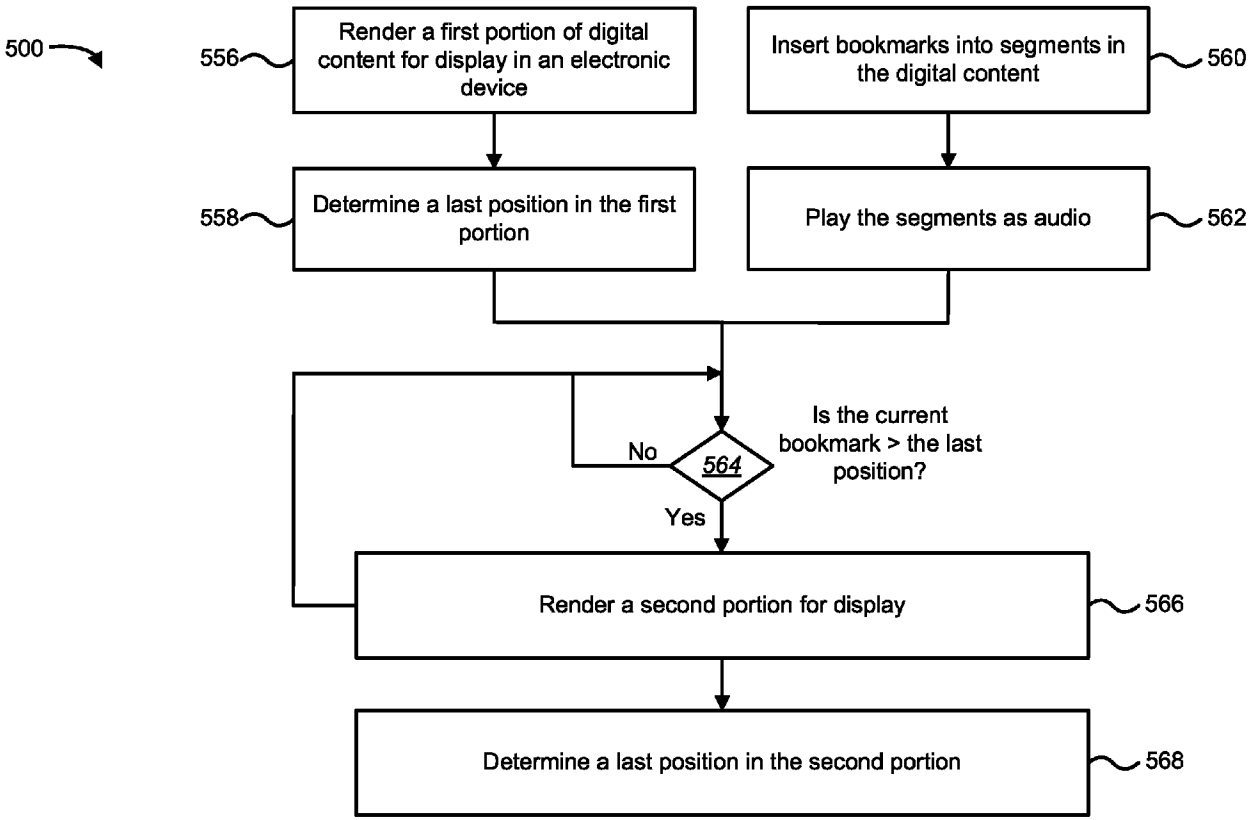
FIG. 5 is a flow diagram illustrating a method for synchronizing the playing and displaying of digital content.

FIG. 5 is a flow diagram illustrating a method 500 for synchronizing the playing and displaying of digital content 412. The method 500 may be performed in an electronic device 404. The electronic device 404 may render 556 a first portion 428*a* of digital content 412 for display. The electronic device 404 may also determine 558 a last position 438 in the first portion 428*a*. The rendering 556 and the determining 558 may be performed by a rendering module 434 in a reader application 408.

The electronic device 404 may also insert 560 bookmarks 424 into segments 426 in the digital content 412 and play 562 the segments 426 as audio using an audio subsystem 414. As the audio subsystem 414 plays 562 the segments 426, it may process the inserted bookmarks 424. The electronic device 404 may then determine 564 if the current bookmark 440 is greater than the last position 438 in the first portion 428*a*. If it is, the electronic device 404 may render 566 a second portion 428*b* for display and determine 568 a last position 438 in the second portion 428*b* (i.e., the newly rendered data). However, if it is determined 564 that the current bookmark 440 is not greater than the last position 438, the electronic device 404 may continue to display the first portion 428*a*. The electronic device 404 may continue to determine 564 whether the current bookmark 440 is greater than the last position 438 as the TTS module 410 processes more bookmarks 424.

The method 500 may also be self-correcting in some cases. For example, some portions 428 of digital content 412 may include no words and only images, or few words with images. In this case, the audio subsystem 414 may speak ahead of the displayed portion 428 (because the reader application 408 may fall behind trying to update the display with the images). However, the method 500 may still issue a display update command 444 as long as the words being read are not included in the currently displayed portion 428.

Furthermore, if a rendered first portion 428*a* is all images or mostly images, the method 500 may wait for a predetermined period of time, e.g., a delay value 432, before displaying the second portion 428*b*. The delay value 432 may be configurable by the user along with other display properties, e.g., font size, device orientation, margin size, etc. Additionally, the delay value 432 may be used to apply to compensate for a fixed delay in the audio subsystem 414. In other words, there may be a fixed delay from the time that the TTS module 410 produces compiled audio 448 until the audio player 452 actually plays the compiled audio. Therefore, the delay value 432 may estimate this fixed delay so that updates to the display 454 occur more closely to the time the compiled audio 448 is actually read, rather than compiled.

Another example of self-correction may be when display properties are changed. For example, the electronic device 404 may display the portion 428 of digital content 412 in landscape or portrait orientation. The last position 438 may be different for each mode. If display properties are changed, a new last position 438 may be sent to the comparison module 442, which may trigger as many display update commands 444 as necessary to synchronize the displayed portion 428 with what is being spoken. This may apply to changes in font size, margin size, etc.

Figure 6:
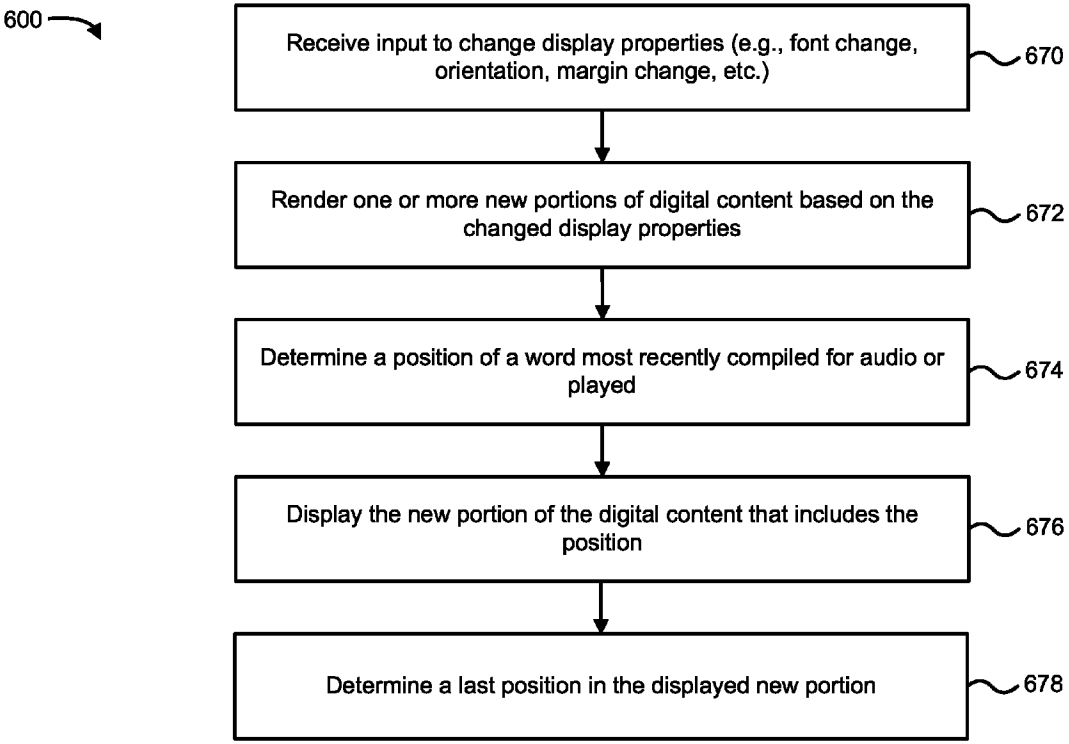
FIG. 6 is a flow diagram of a method for synchronizing the displaying and playing of digital content after display properties are changed.

FIG. 6 is a flow diagram of a method 600 for synchronizing the displaying and playing of digital content 412 after display properties are changed. In other words, the method 600 may be used alternatively or in addition to the method 500 of FIG. 5 when display properties are changed, e.g., font size, device orientation (landscape/portrait), margin size, etc. The method 600 may be performed in an electronic device 404. The electronic device 404 may receive 670 input to change display properties. This input may be received 670 via a user interface 430. The electronic device 404 may then render 672 one or more portions 428 of digital content 412 based on the changed display properties, i.e., render portions 436 that apply the new display properties. The position of the word most recently compiled for audio or most recently played may then be determined 674, i.e., the current bookmark 440. The electronic device 404 may then display 676 a portion 428 that includes the position of the word most recently compiled for audio or most recently played. The electronic device 404 may then determine 678 a last position 438 in the portion 428, i.e., the new portion.

Figure 7:
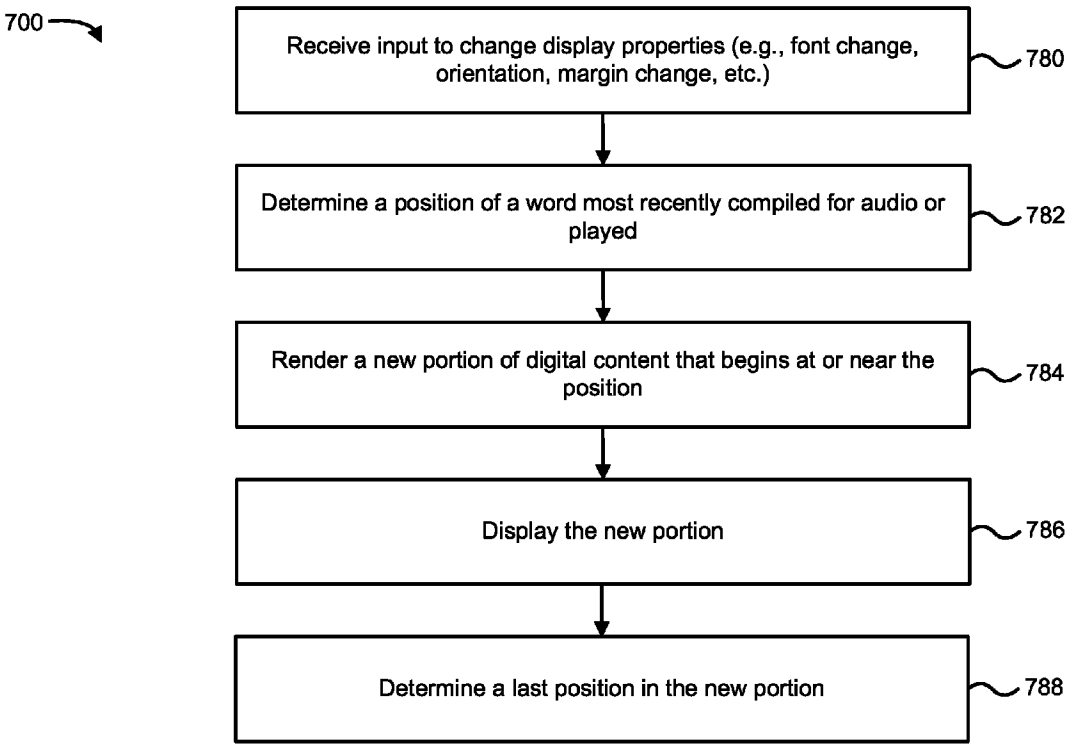
FIG. 7 is another flow diagram of a method for synchronizing the displaying and playing of digital content after display properties are changed.

FIG. 7 is another flow diagram of a method 700 for synchronizing the displaying and playing of digital content 412 after display properties are changed. In other words, the method 700 may be used alternatively or in addition to the method 500 of FIG. 5 when display properties are changed. An electronic device 404 may receive 780 input to change display properties. The electronic device 404 may then determine 782 a position of a word most recently compiled for audio or played, i.e., the current bookmark 440.

The electronic device 404 may then render 784 a portion 436 that begins at or near the current bookmark 440. The audio subsystem 414 may continue to compile audio 448 and read the audio 448 as the rendering module 434 renders a new portion 436. Therefore, in one configuration, the rendering module 434 may estimate the position of the word being compiled or played by the time the rendering is done. For example, if an average portion 436 requires 1.5 seconds to render, the position of the current bookmark 440 is 1000, and the audio subsystem 414 reads at an average of 2 words per second, then the rendering module 434 may render starting at the word at position 1003 (1000+2*1.5=1003). The electronic device 404 may then display 786 the rendered portion 436 and determine 788 a last position 438 in the portion.

Note that in the method 600 of FIG. 6 multiple portions 436 may be rendered using the new display properties and then a portion 436 may be chosen based on the position of a word most recently compiled or played. In the method 700 of FIG. 7, however, the position of a word most recently compiled or played may be determined first, and then the portion 436 may be rendered based on the position.

Figure 8:
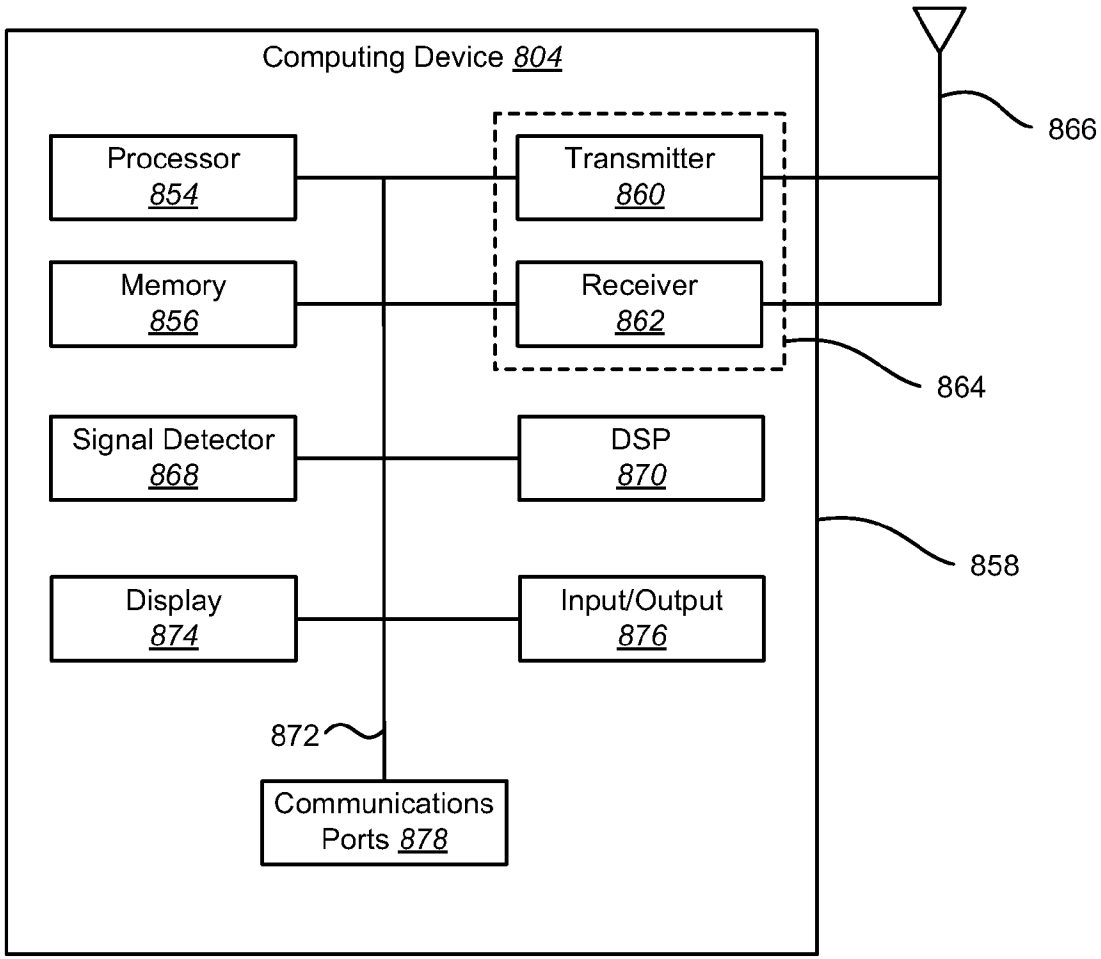
FIG. 8 illustrates various components that may be utilized in a computing device.

FIG. 8 illustrates various components that may be utilized in one configuration of an electronic device 104. One configuration of an electronic device 104 may be a computing device 804. In other words, the present systems and methods may be implemented in e-book readers, or on other types of computing devices, such as personal computers, laptop computers, personal digital assistants (PDAs), smartphones, game consoles, etc.

The computing device 804 may include a processor 854 that controls operation of the computing device 804. The processor 854 may also be referred to as a central processing unit (CPU). Memory 856, which may include both read-only memory (ROM) and random access memory (RAM), provides instructions and data to the processor 854. A portion of the memory 856 may also include non-volatile random access memory (NVRAM). The processor 854 typically performs logical and arithmetic operations based on program instructions stored within the memory 856. The instructions in the memory 856 may be executable to implement the methods described herein.

The computing device 804 may also include a housing 858 that may include a transmitter 860 and a receiver 862 to allow transmission and reception of data between the computing device 804 and a remote location. The transmitter 860 and receiver 862 may be combined into a transceiver 864. An antenna 866 may be attached to the housing 858 and electrically coupled to the transceiver 864. The computing device 804 may also include (not shown) multiple transmitters, multiple receivers, multiple transceivers and/or multiple antenna.

The computing device 804 may also include a signal detector 868 that may be used to detect and quantify the level of signals received by the transceiver 864. The signal detector 868 may detect such signals as total energy, pilot energy per pseudonoise (PN) chips, power spectral density, and other signals. The computing device 804 may also include a digital signal processor (DSP) 870 for use in processing signals.

The computing device 804 may also include one or more communication ports 878. Such communication ports 878 may allow direct wired connections to be easily made with the computing device 804.

Additionally, input/output components 876 may be included with the computing device 804 for various input and output to and from the computing device 804. Examples of different kinds of input components include a keyboard, keypad, mouse, microphone, remote control device, buttons, joystick, trackball, touchpad, lightpen, etc. Examples of different kinds of output components include a speaker, printer, etc. One specific type of output component is a display 874.

The various components of the computing device 804 may be coupled together by a bus system 872 which may include a power bus, a control signal bus, and a status signal bus in addition to a data bus. However, for the sake of clarity, the various busses are illustrated in FIG. 8 as the bus system 872.

As used herein, the term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The various illustrative logical blocks, modules and circuits described herein may be implemented or performed with a general purpose processor, a digital signal processor (DSP), an application specific integrated circuit (ASIC), a field programmable gate array signal (FPGA) or other programmable logic device, discrete gate or transistor logic, discrete hardware components or any combination thereof designed to perform the functions described herein. A general purpose processor may be a microprocessor, but in the alternative, the processor may be any conventional processor, controller, microcontroller or state machine. A processor may also be implemented as a combination of computing devices, e.g., a combination of a DSP and a microprocessor, a plurality of microprocessors, one or more microprocessors in conjunction with a DSP core or any other such configuration.

The steps of a method or algorithm described herein may be embodied directly in hardware, in a software module executed by a processor or in a combination of the two. A software module may reside in any form of storage medium that is known in the art. Some examples of storage media that may be used include RAM memory, flash memory, ROM memory, EPROM memory, EEPROM memory, registers, a hard disk, a removable disk, a CD-ROM and so forth. A software module may comprise a single instruction, or many instructions, and may be distributed over several different code sections, among different programs and across multiple storage media. An exemplary storage medium may be coupled to a processor such that the processor can read information from, and write information to, the storage medium. In the alternative, the storage medium may be integral to the processor.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

The functions described may be implemented in hardware, software, firmware, or any combination thereof. If implemented in software, the functions may be stored as one or more instructions on a computer-readable medium. A computer-readable medium may be any available medium that can be accessed by a computer. By way of example, and not limitation, a computer-readable medium may comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

Functions such as executing, processing, performing, running, determining, notifying, sending, receiving, storing, requesting, and/or other functions may include performing the function using a web service. Web services may include software systems designed to support interoperable machine-to-machine interaction over a computer network, such as the Internet. Web services may include various protocols and standards that may be used to exchange data between applications or systems. For example, the web services may include messaging specifications, security specifications, reliable messaging specifications, transaction specifications, metadata specifications, XML specifications, management specifications, and/or business process specifications. Commonly used specifications like SOAP, WSDL, XML, and/or other specifications may be used.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. An electronic device that is configured to synchronize the playing and displaying of digital content, the electronic device comprising:

a processor;

memory in electronic communication with the processor;

instructions stored in the memory, the instructions being executable to:

render a first portion of the digital content for display on the electronic device;

insert a plurality of markings into a copy of the digital content provided to a text-to-speech engine at a corresponding plurality of locations within the digital content;

play speech audio corresponding to a portion of the digital content, the speech audio produced using the text-to-speech engine, the text-to-speech engine configured to convert the digital content to the speech audio;

compare a first marking corresponding to the portion of the speech audio being played with a second marking corresponding to a location in the first portion of the digital content or a location in a second portion of the digital content; and responsive to determining, based on the compare of the first marking with the second marking, that the first marking corresponds to either an end of the first portion of the digital content or a beginning of a second portion of the digital content, render the second portion of the digital content for display on the electronic device.

2. An electronic device as recited in claim 1, wherein the digital content is void of page delineations.

3. An electronic device as recited in claim 1, further comprising instructions executable to wait a period of time before rendering the second portion of the digital content based on a configurable delay value that is associated with a number of images that are included in the first portion of the digital content.

4. An electronic device as recited in claim 1, further comprising instructions executable to:

receive input to change a display property of the digital content;

identify, based on the plurality of markings and the change in the display property, a third portion of the digital content that corresponds to the current progress of the speech audio, and satisfies the change in the display property; and render the third portion of the digital content based on the display property.

5. An electronic device as recited in claim 4, wherein the display property comprises a font size.

6. An electronic device as recited in claim 4, wherein the display property comprises a margin size.

7. An electronic device as recited in claim 4, wherein the display property comprises a page orientation.

8. An electronic device as recited in claim 1, wherein the electronic device comprises an electronic book (eBook) reader, and wherein the digital content comprises an eBook.

9. A method for visually displaying and audibly playing digital content comprising:

rendering a first portion of the digital content for display on an electronic device;

inserting markings into the digital content at corresponding positions within the digital content;

synthesizing text in the first portion of the digital content into audio;

playing the audio;

comparing a first marking corresponding to a portion of speech audio being played with a second marking corresponding to a location in the first portion of the digital content or a location in a second portion of the digital content; and responsive to determining, based on the comparing of the first marking with the second marking, that a progress of the playing of the audio has reached a particular position that corresponds either to an end of the first portion of the digital content or a beginning of the second portion of the digital content, rendering the second portion of the digital content for display.

10. A method as recited in claim 9, wherein the digital content is void of page delineations.

11. A method as recited in claim 9, further comprising waiting a period of time before rendering the second portion of the digital content based on a configurable delay value that is associated with a number of images that are included in the first portion of the digital content.

12. A method as recited in claim 9, further comprising:

receiving input to change a display property of the digital content;

identifying a third portion of the digital content that fits a display screen of the electronic device upon changing the display property and that corresponds to a current portion of the audio that is being played; and rendering the third portion of the digital content based on the display property that is changed.

13. A method as recited in claim 12, wherein the display property comprises a font size.

14. A method as recited in claim 12, wherein the display property comprises a margin size.

15. A method as recited in claim 12, wherein the display property comprises a page orientation.

16. A method as recited in claim 9, wherein the electronic device comprises an electronic book (eBook) reader, and wherein the digital content comprises an eBook.

17. A non-transitory computer-readable medium comprising instructions executable by a processor for:

rendering a first portion of digital content for display on an electronic device;

inserting markings into the digital content at corresponding positions within the digital content;

synthesizing text of the digital content into audio data;

playing the audio data;

comparing a first marking corresponding to a location in the first portion of the digital content with a second marking corresponding to an end of the first portion of the digital content or a beginning of a second portion of the digital content; and responsive to determining, based on the comparing of the first marking with the second marking, that a progress of playing the audio data corresponds to either the end of the first portion of the digital content or the beginning of the second portion of the digital content, rendering the second portion of the digital content for display.

18. A non-transitory computer-readable medium as recited in claim 17, wherein the playing the audio data includes synthesizing text in the first portion of the digital content and the second portion of the digital content into audio data.

19. A non-transitory computer-readable medium as recited in claim 17, wherein the corresponding positions separate a predetermined number of text words of the digital content.

20. A non-transitory computer-readable medium of claim 17, wherein the markings are not rendered for display.

* * * * *